US010590727B1

(12) United States Patent
Christopherson et al.

(10) Patent No.: US 10,590,727 B1
(45) Date of Patent: Mar. 17, 2020

(54) HANGER SYSTEM

(71) Applicant: Cameron International Corporation, Houston, TX (US)

(72) Inventors: Adam Christopherson, Houston, TX (US); Delbert Vanderford, Houston, TX (US); Jose Navar, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 16/269,433

(22) Filed: Feb. 6, 2019

(51) Int. Cl.
*E21B 33/04* (2006.01)
*E21B 33/06* (2006.01)
*E21B 41/00* (2006.01)

(52) U.S. Cl.
CPC ..... *E21B 33/0422* (2013.01); *E21B 33/06* (2013.01); *E21B 41/00* (2013.01)

(58) Field of Classification Search
CPC .... E21B 33/0422; E21B 33/043; E21B 33/06; E21B 41/00; E21B 41/0007
See application file for complete search history.

(56) References Cited

U.S. PATENT DOCUMENTS 4,982,795 A * 1/1991 King ..... E21B 33/0422 166/382
5,287,922 A 2/1994 Bridges
9,045,960 B2 * 6/2015 Vanderford ..... E21B 23/00

* cited by examiner

*Primary Examiner* — Matthew R Buck
(74) *Attorney, Agent, or Firm* — Fletcher Yoder, P.C.

(57) ABSTRACT

A system that includes a wellhead. The wellhead defines a bore. A hanger system is positioned within the wellhead. The hanger system includes a piston angled relative to a longitudinal axis of the bore. A first spring biases the piston in a first direction. The piston contacts a slip segment to couple the slip segment to a casing string.

18 Claims, 9 Drawing Sheets

HANGER SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are used to access and extract the resource. These systems may be located onshore or offshore depending on the location of the resource. These systems generally include a wellhead through which the well is drilled. These wellheads may include a wide variety of components and/or conduits, such as various casings, hangers, valves, fluid conduits, and the like, that control drilling and/or extraction operations. In drilling and production systems, a hanger may be used to suspend strings (e.g., piping) within the well to facilitate extraction of the resource. Such hangers may be disposed within and supported by a housing of the wellhead. In some cases, a tool may be used to lower the hanger to a landed position within the wellhead. After reaching the landed position, the hanger may be locked (e.g., mechanically locked) into position within the wellhead.

SUMMARY

In an embodiment, a system that includes a wellhead. The wellhead defines a bore. A hanger system is positioned within the wellhead. The hanger system includes a piston angled relative to an axis of the bore. A first spring biases the piston in a first direction. The piston contacts a slip segment to couple the slip segment to a casing string.

In another embodiment, a system that includes a hanger system positioned within a wellhead housing. The hanger system couples to and supports a casing string within the wellhead housing. The hanger system includes a piston and a first spring that biases the piston in a first direction. The piston contacts a slip segment to couple the slip segment to a conduit. A collar couples to the piston. A second spring biases the collar in a second direction, with the second direction being opposite the first direction.

In another embodiment, a system that includes a wellhead and a casing string. A hanger system couples to and suspends the casing string within the wellhead. The hanger system includes a piston. A first spring biases the piston in a first direction. The piston contacts a slip segment to couple the slip segment to the casing string. A collar couples to the piston. A second spring biases the collar in a second direction with the second direction being opposite the first direction.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Reference will now be made in detail to specific embodiments illustrated in the accompanying drawings and figures. In the following detailed description, numerous specific details are set forth in order to provide a thorough understanding of the disclosure. However, it will be apparent to one of ordinary skill in the art that embodiments may be practiced without these specific details. In other instances, well-known methods, procedures, components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

The present disclosure relates to a hanger system that couples to and supports a conduit in a mineral extraction system. For example, the hanger system may couple to and support a casing string (i.e., a series of pipes coupled together) within a wellhead of the mineral extraction system. The hanger system enables installation through the blowout prevent (BOP) stack. That is, the BOP stack may not be removed in order to couple the hanger system to a casing string. This may reduce installation time of the hanger system as well as complications associated with removing and reinstalling a BOP stack.

Figure 1:
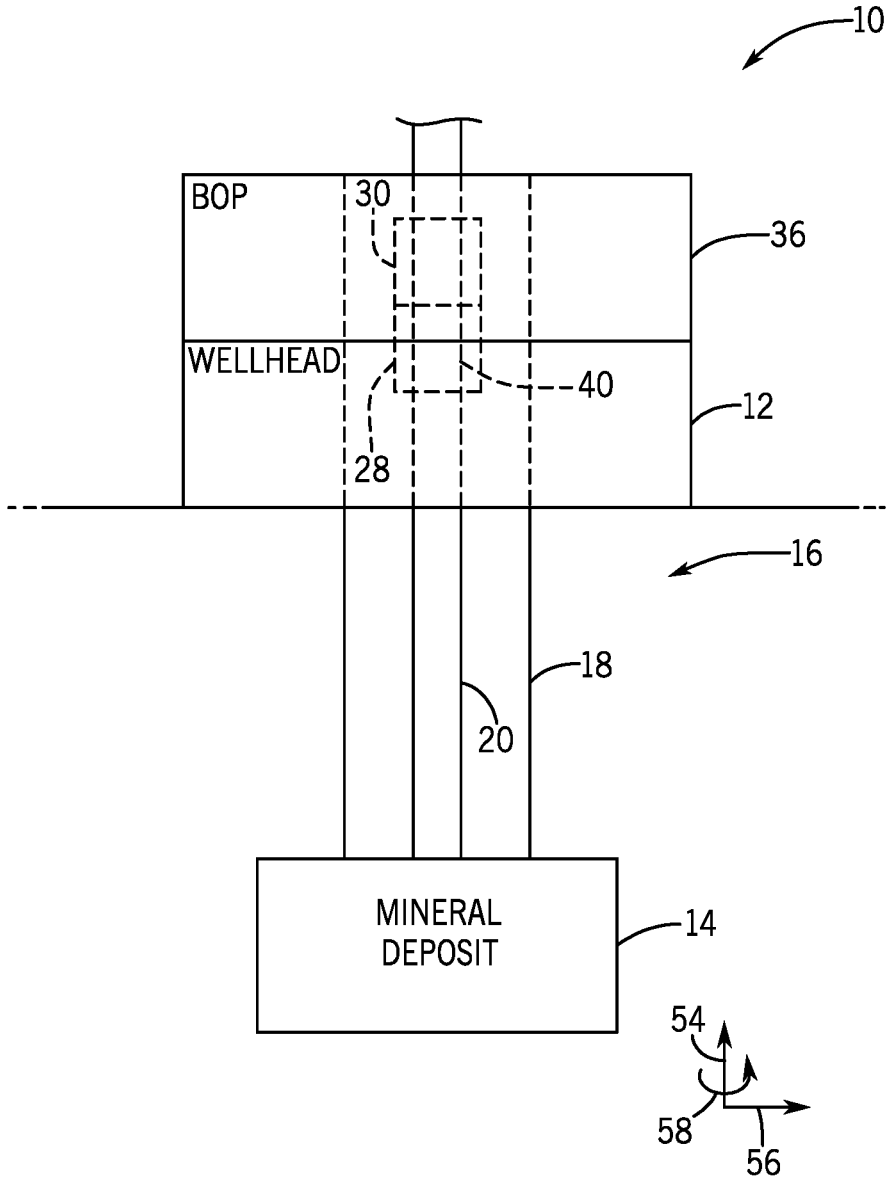
FIG. 1 is a block diagram of a mineral extraction system, in accordance with an embodiment of the present disclosure.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or offshore (e.g., an offshore platform system). The mineral extraction system 10 includes a wellhead 12 coupled to a mineral deposit 14 via a well 16. The well 16 includes a well bore 18.

The wellhead 12 may include multiple components that control and regulate activities and conditions associated with the well 16. For example, the wellhead 12 generally includes bodies, valves, and seals that route fluid flow from the mineral deposit 14, regulate pressure in the well 16, and inject chemicals down-hole into the well bore 18. The system 10 may include other devices that are coupled to the wellhead 12, and devices that are used to assemble and control various components of the wellhead 12. For example, in the illustrated embodiment, the system 10 includes a hanger running tool 30 that may be used to lower the hanger 28 to a landed position within the wellhead 12. A pressure controlling system 36 (e.g., a blowout preventer [BOP] stack, diverters, spacers, risers, adapters, and the like) may also be included as part of the mineral extraction system 10. The pressure controlling system 36 may consist of a variety of valves, fittings, and controls to prevent oil, gas, or other fluid from exiting the well 16 in the event of an unintentional release of pressure or an overpressure condition during a drilling phase.

As will be appreciated, the well bore 18 may contain elevated pressures. Accordingly, the mineral extraction system 10 may employ various mechanisms, such as seals, plugs, and valves, to control and regulate fluid flow from the well 16. For instance, the illustrated hanger 28 is disposed within the wellhead 12 to secure tubing and casing suspended in the well bore 18, and to provide a path for hydraulic control fluid, chemical injections, and so forth. The hanger 28 includes a hanger bore 40 that extends through the center of the hanger 28, and that is in fluid communication with and provides pressure integrity with a bore of the hanger running tool 30 and a tubing string 20 (e.g., casing string) during an installation phase. To facilitate the discussion below, the mineral extraction system 10 of FIG. 1, and the components therein, may be described with reference to an axial axis or direction 54, a radial axis or direction 56, and a circumferential axis or direction 58.

Figure 2:
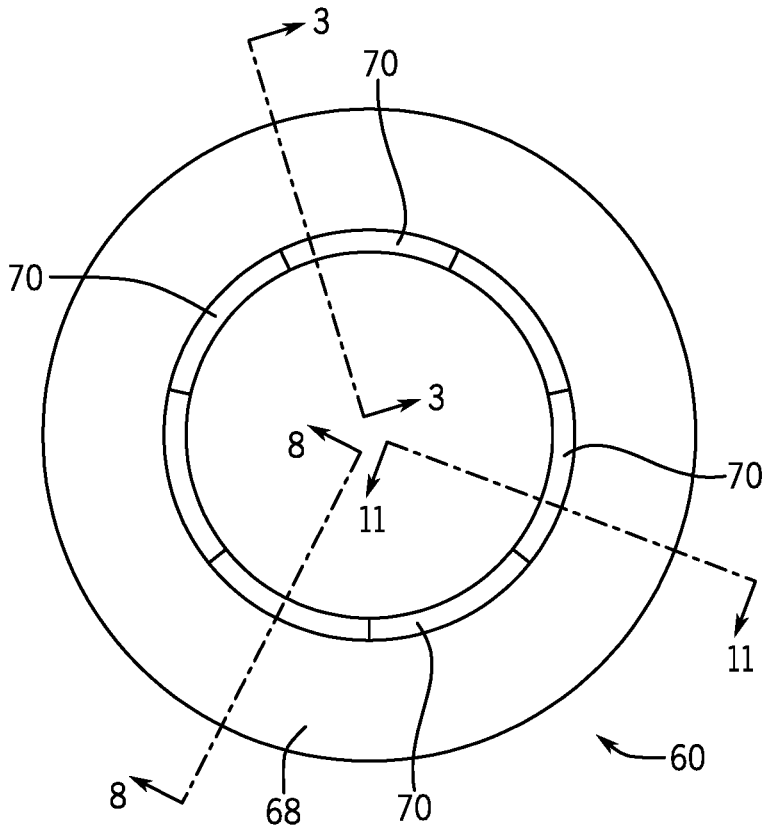
FIG. 2 is a top view of a hanger system that may be used to retain a conduit within a wellhead of the mineral extraction system of FIG. 1, in accordance with an embodiment of the present disclosure.
Figure 3:
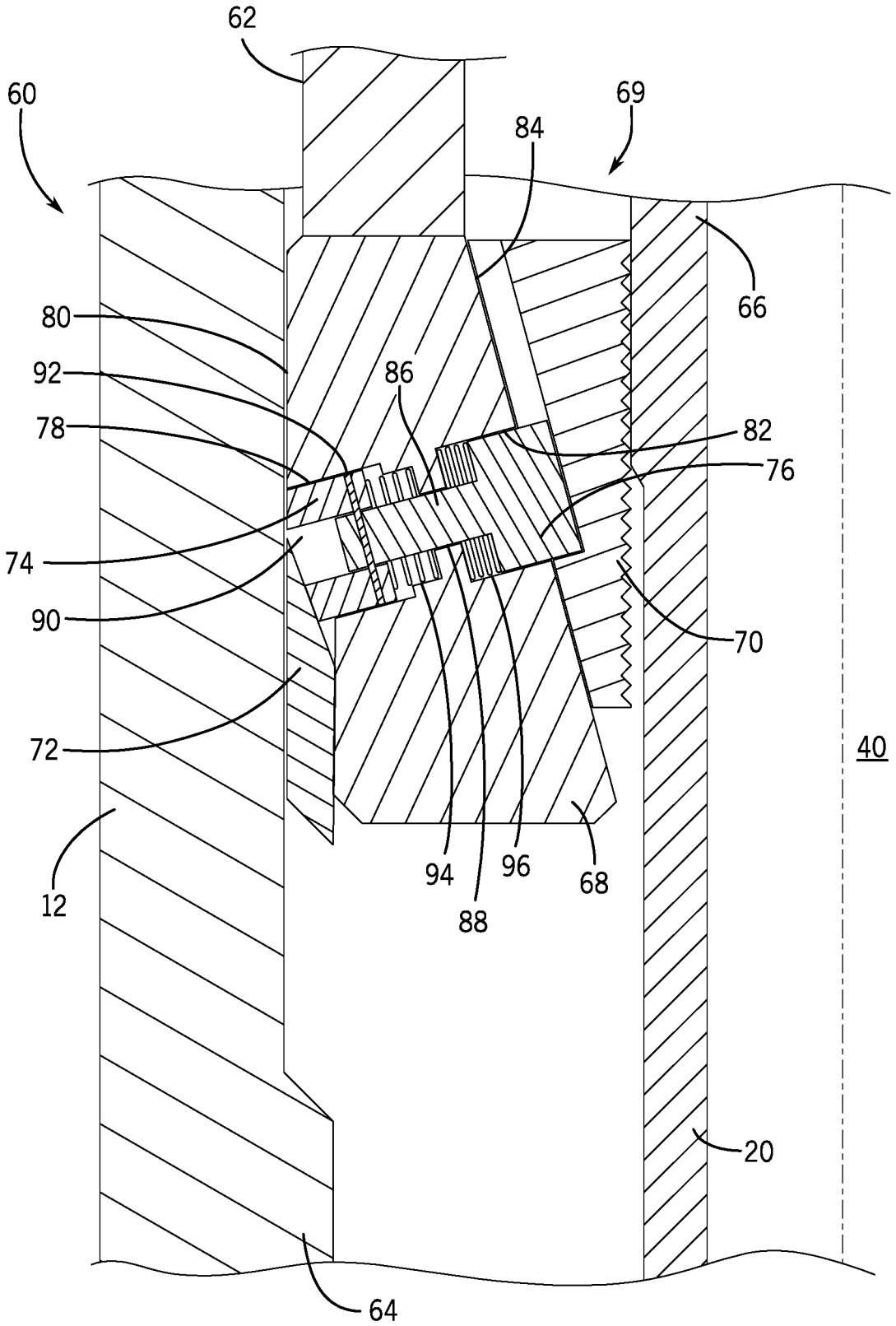
FIG. 3 is a cross-sectional view of the hanger lock system along line 3-3 in FIG. 2 within a wellhead of the mineral extraction system of FIG. 1, in accordance with an embodiment of the present disclosure.

FIG. 2 is a top view of the hanger system 60 that may be used to retain a conduit within a wellhead 12 of the mineral extraction system 10 of FIG. 1. As will be become apparent in the discussion below, the cross-sections illustrated by the lines in FIG. 2 may be applicable to each slip segment 70 of the hanger system 60. FIG. 3 is a cross-sectional view of a hanger system 60 that couples the string 20 to the wellhead 12 along line 3-3 of FIG. 2. In operation, the hanger system 60 is lowered with a tool 62 into the wellhead 12. To facilitate insertion of the hanger system 60, the tool 62 is positioned between the string 20 and an interior surface 64 of the wellhead 12. As the hanger system 60 is lowered into the wellhead 12, the hanger system 60 passes through one or more BOPs 36 and/or over joints 66 that couple conduit sections (e.g., pipes) together to form the string 20.

The hanger system 60 includes a carrier or housing 68 that supports a hanger lock system 69 as the hanger system 60 is lowered into the wellhead 12. The hanger lock system 69 includes one or more slip segments 70 and lugs 72 (e.g., load lugs) that enable the hanger lock system 69 to couple to and suspend a string 20 within the wellhead 12. In order to transfer force from the lug 72 to the slip segment 70, the hanger lock system 69 includes a collar 74 that couples to a piston 76. The collar 74 is supported by the carrier 68 and rests within a first counterbore 78 formed on an exterior surface 80 of the carrier 68. The piston 76 is similarly supported by the carrier 68, but rests within a second counterbore 82 formed in an interior surface 84 of the carrier 68.

In order to couple the piston 76 to the collar 74, a shaft 86 extends from the piston 76 through an aperture 88 in the carrier 68 and through an aperture 90 in the collar 74. The shaft 86 couples to the collar 74 with a shear pin 92. The shear pin 92 enables the hanger lock system 69 to be lowered in a compressed state through one or more BOPs of the BOP stack 36 and/or over one or more joints 66. More specifically, the shear pin 92 enables a first spring 94 (e.g., collar spring) to compress a second spring 96 (e.g., piston spring) and thus biases the piston 76 away from the string 20. More specifically, the first spring 94 biases the collar 74 against the lug 72 and/or the interior surface 64 of the wellhead 12. The force of the first spring 94 is transferred to the collar 74. The collar 74 transfers the force to the shaft 86 through the shear pin 92. The shaft 86 in turn transfers the force to the piston 76 which then contacts and compresses the second spring 96. In order to compress the second spring 96 the first spring 94 has a spring constant that is greater than the second spring 96.

Figure 4:
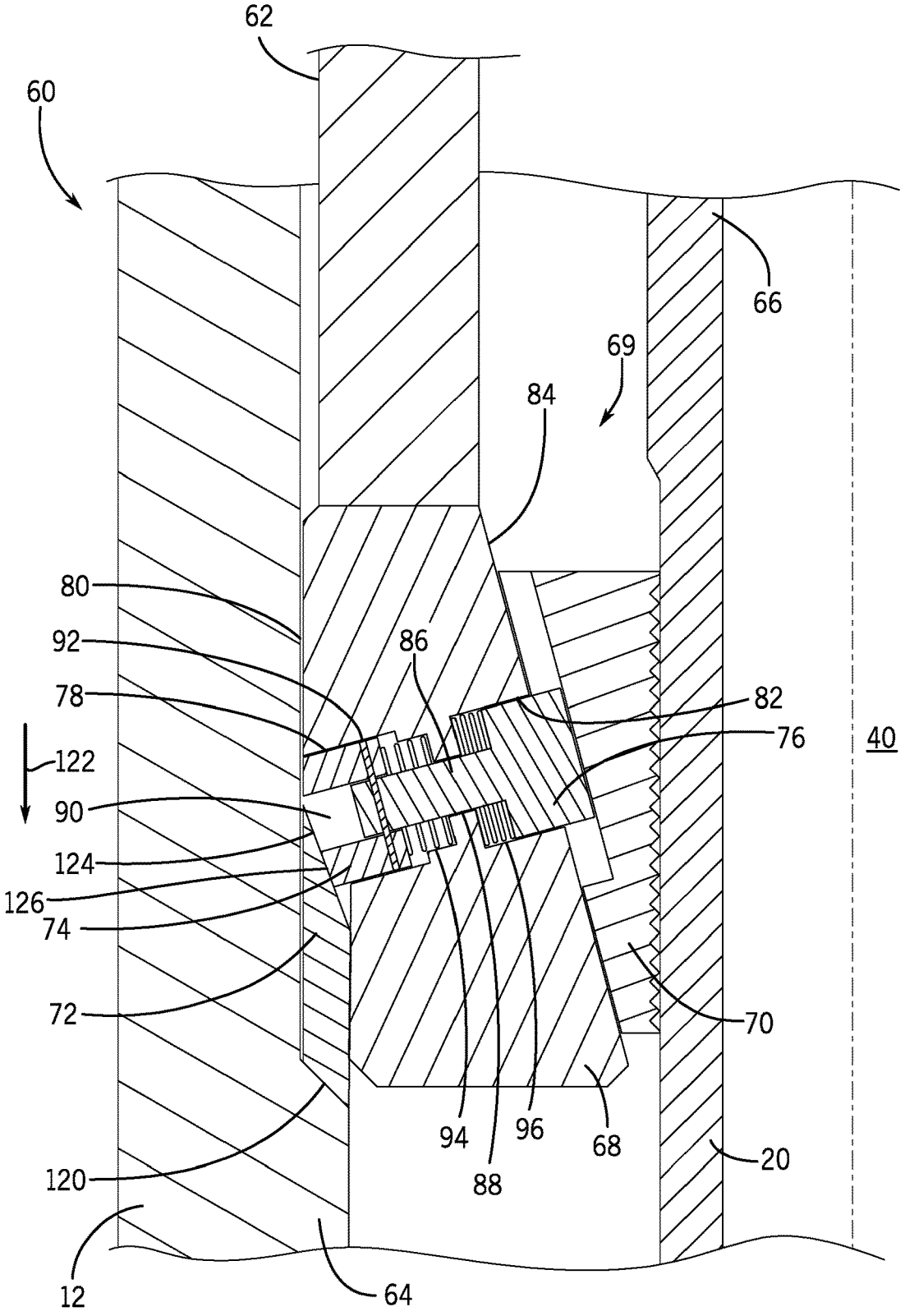
FIG. 4 is a cross-sectional view of the hanger lock system along line 3-3 in FIG. 2 within a wellhead of the mineral extraction system of FIG. 1, in accordance with an embodiment of the present disclosure.

FIG. 4 is a cross-sectional view of a hanger lock system 69 within the wellhead 12. As illustrated, the hanger lock system 69 is lowered into the wellhead 12 enabling the lug 72 to contact a ledge 120 on the interior surface 64 of the wellhead 12. After contacting the ledge 120, the tool 62 continues to drive the carrier 68 in direction 122. The force of the tool 62 in direction 122 enables the lug 72 to slide over the collar 74 and compress the first spring 94. As illustrated, the lug 72 includes an angled or tapered surface 124. This angled surface 124 contacts a corresponding angled or tapered surface 126 on the collar 74. Accordingly, as the carrier 68 moves in direction 122 the angled surface 124 slides over the tapered surface 126 on the collar 74, which compresses the first spring 94.

Figure 5:
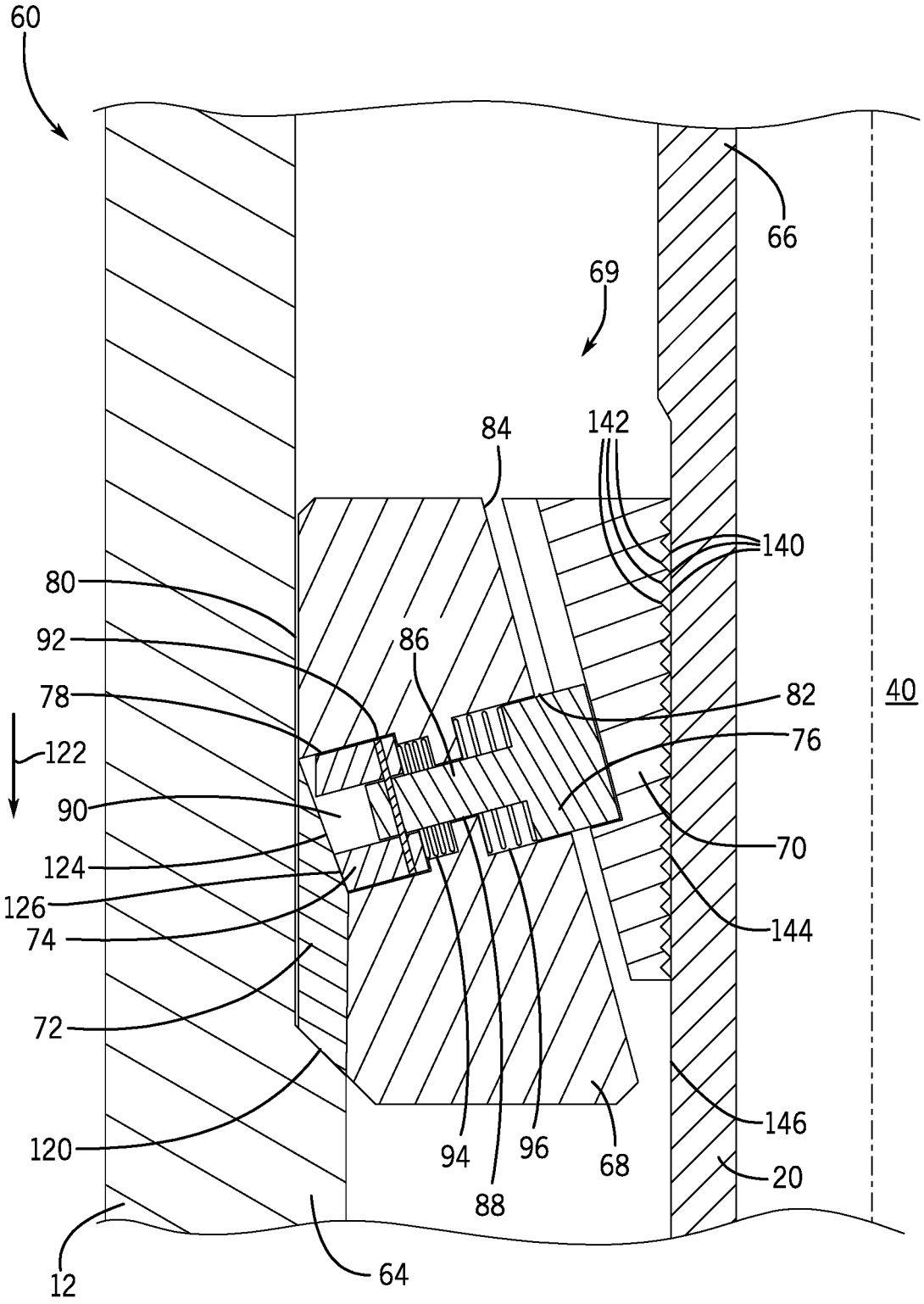
FIG. 5 is a cross-sectional view of the hanger lock system along line 3-3 in FIG. 2 within a wellhead of the mineral extraction system of FIG. 1, in accordance with an embodiment of the present disclosure.

FIG. 5 is a cross-sectional view of the hanger lock system 69 lowered into position within the wellhead 12. As the carrier 68 continues to move in direction 122, the lug 72 continues to drive the collar 74 further into the first counterbore 78 compressing the first spring 94. The movement of the collar 74 is transferred through the shaft 86 to the piston 76, which drives the piston 76 out of the second counterbore 82. As the piston 76 moves out of the second counterbore 82, it drives the slip segment 70 radially inward and into contact with the string 20. In some embodiments, the slip segment 70 may include a plurality of protrusions 140 separated by recesses 142 (e.g., teeth) on the surface 144 that enable the slip segment 70 to contact and grip an exterior surface 146 of the string 20.

Figure 6:
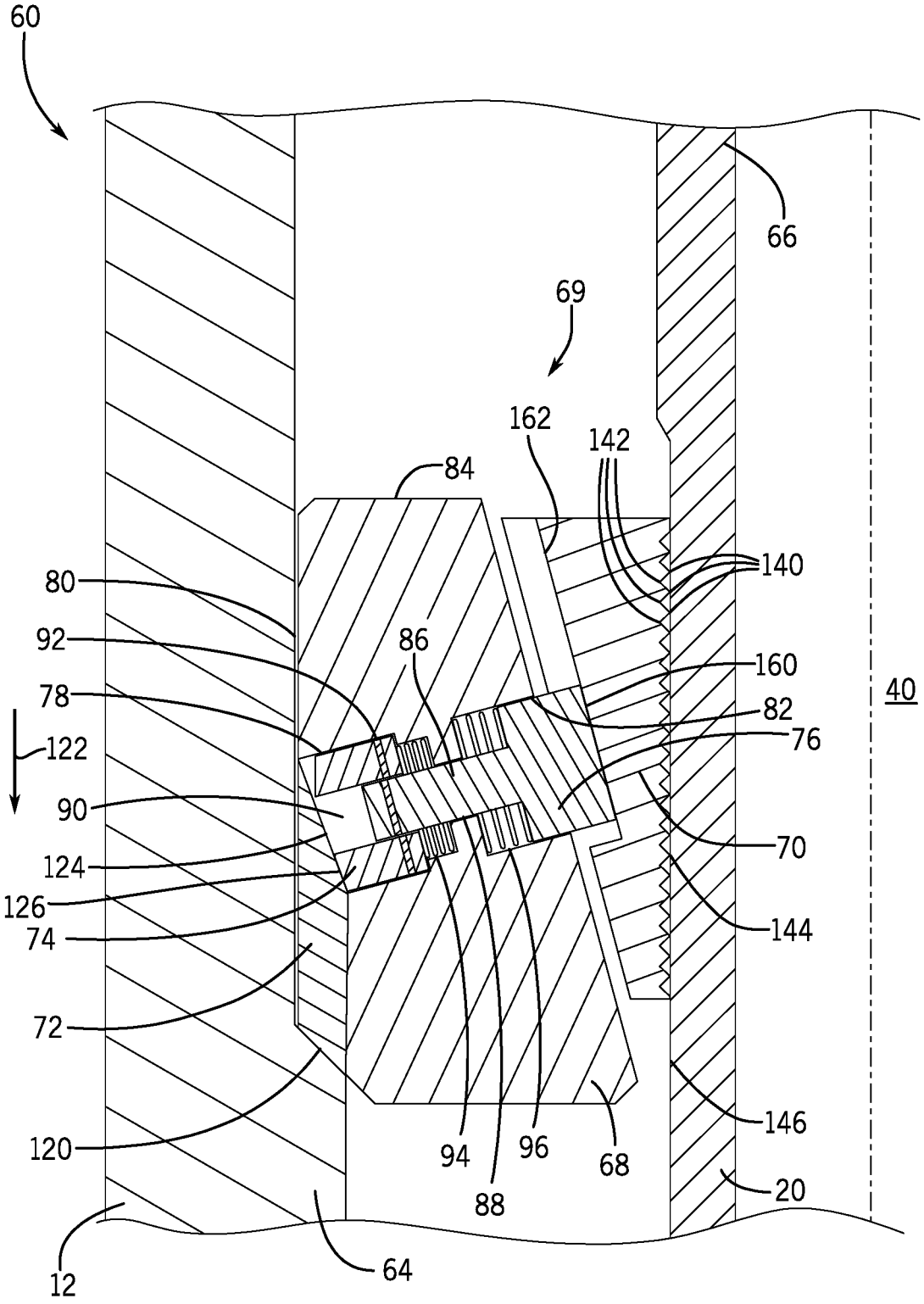
FIG. 6 is a cross-sectional view of the hanger lock system along line 3-3 in FIG. 2 within a wellhead of the mineral extraction system of FIG. 1, in accordance with an embodiment of the present disclosure.

FIG. 6 is a cross-sectional view of the hanger lock system 69 with the slip segment 70 engaging the string 20. After the slip segment 70 contacts the exterior surface 146 of the string 20, the string 20 is released enabling the string 20 to move in direction 122. The slip segment 70 maintains contact with the string 20 and moves with the string 20 in direction 122. As the slip segment 70 moves in direction 122, the slip segment 70 slides over the end face 160 of the piston 76. As illustrated, the piston 76 rests within an angled groove 162 of the slip segment 70. Accordingly, as the slip segment 70 moves in axial direction 122, the slip segment 70 drives the piston 76 into the second counterbore 82 compressing the second spring 96.

Figure 7:
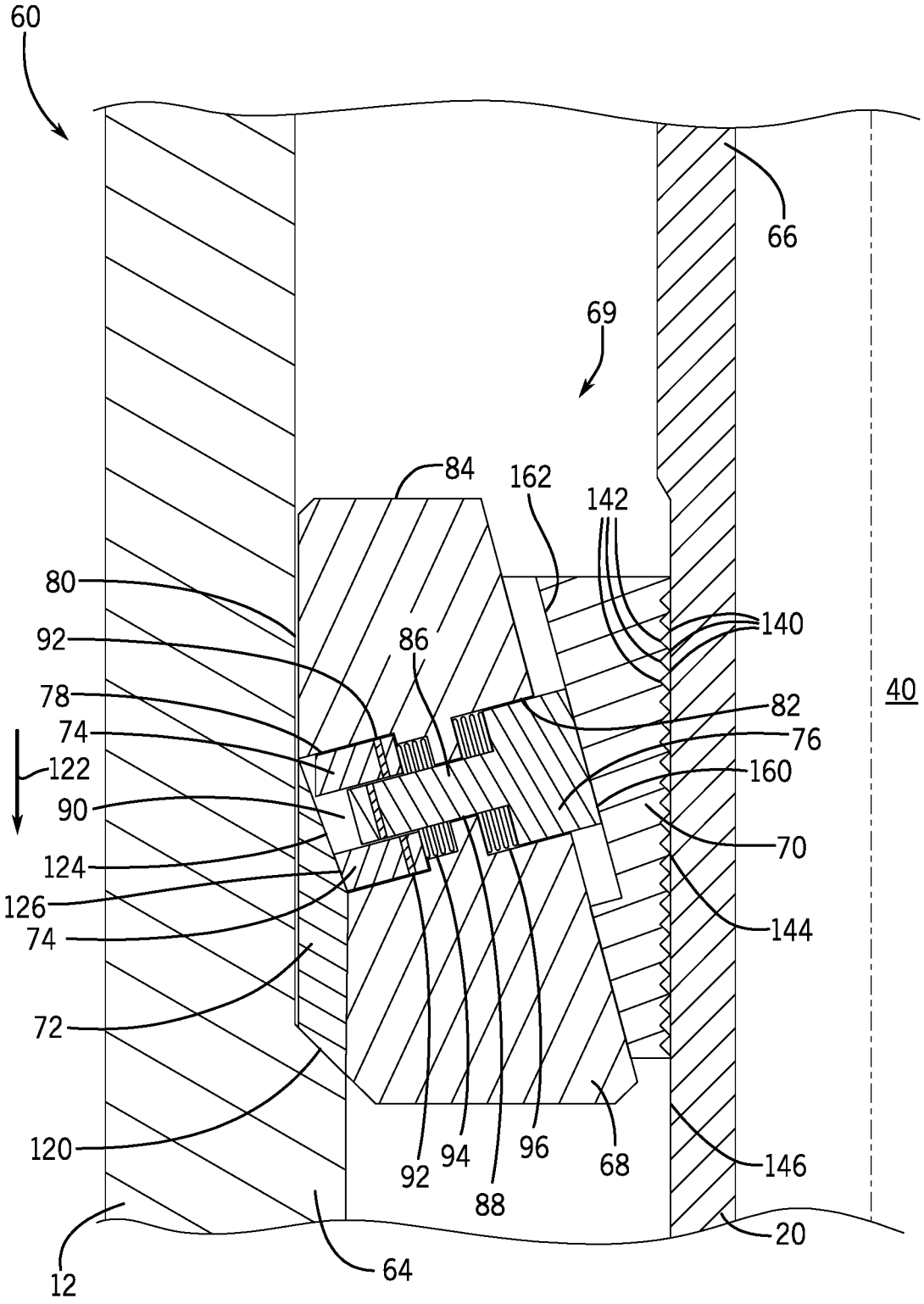
FIG. 7 is a cross-sectional view of the hanger lock system along line 3-3 in FIG. 2 within a wellhead of the mineral extraction system of FIG. 1, in accordance with an embodiment of the present disclosure.

FIG. 7 is a cross-sectional view of the hanger lock system 69 with the slip segment 70 engaging the string 20. As the string 20 continues to move in direction 122, the piston 76 is driven further into the second counterbore 82. As the piston 76 moves further into the second counterbore 82, the piston 76 drives the shaft 86 until the force overcomes the strength of the shear pin 92. After shearing through the shear pin 92, the shaft 86 slides further into the collar 74. As the shaft 86 slides further into the collar 74 the piston 76 retracts. The slip segment 70 therefore continues to move in direction 122 as it slides over the end face 160 of the piston 76. The contact between the end face 160 of the piston 76 and the angled groove 162 drives the slip segment 70 radially inward in direction 56 and into forced engagement with the string 20. In this way, the hanger lock system 69 couples to and suspends the string 20 within the wellhead 12.

Figure 8:
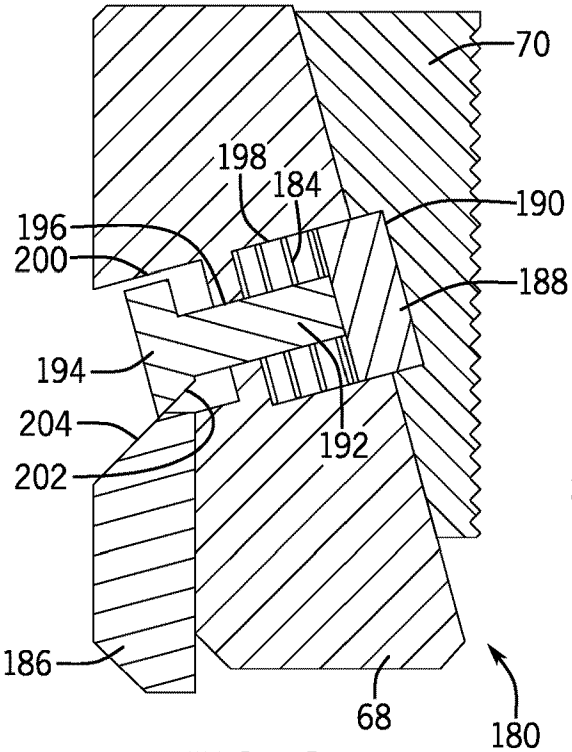
FIG. 8 is a cross-sectional view of a slip release system of the hanger system along line 8-8 of FIG. 2, in accordance with an embodiment of the present disclosure.

FIG. 8 is a cross-sectional view of a slip release system 180 of the hanger system 60 along line 8-8 of FIG. 2. In some embodiments, the hanger system 60 may include one or more slip release systems 180 that reduces and/or blocks sliding of the slip segments 70, with respect to the carrier 68, before the hanger system 60 is properly positioned within the wellhead 12. The slip release system 180 includes a dumbbell piston 182, a spring 184, and a release lug 186. As illustrated, the dumbbell piston 182 includes a first piston head 188 that extends into a recess 190 on the slip segment 70. When the first piston head 188 rests within the recess 190, the slip release system 180 reduces and/or blocks the slip segment 70 from excessive movement in direction 122 and thus premature radially outward movement. The first piston head 188 couples to a shaft 192, which in turn couples to a second piston head 194. The shaft 192 extends through an aperture 196 in the carrier 68 in order to couple the first piston head 188 to the second piston head 194, which slide within respective first and second counterbores 198 and 200.

Figure 10:
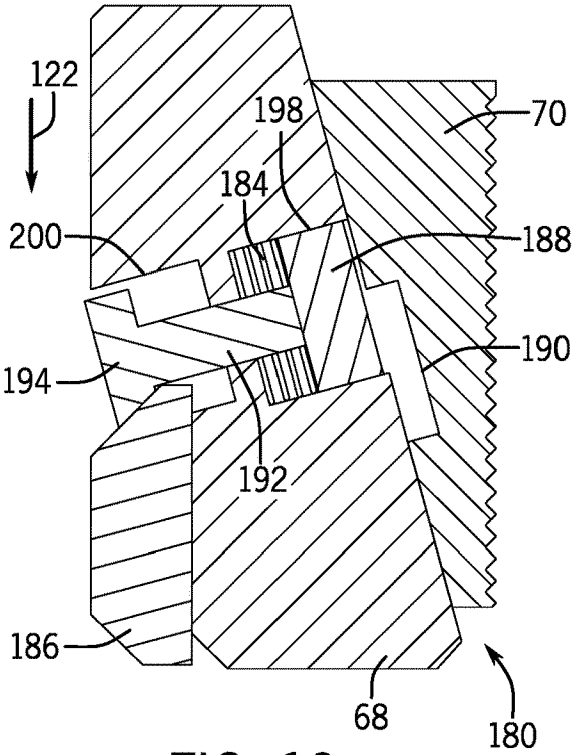
FIG. 10 is a cross-sectional view of a slip release system of the hanger system along line 8-8 of FIG. 2, in accordance with an embodiment of the present disclosure.
Figure 9:
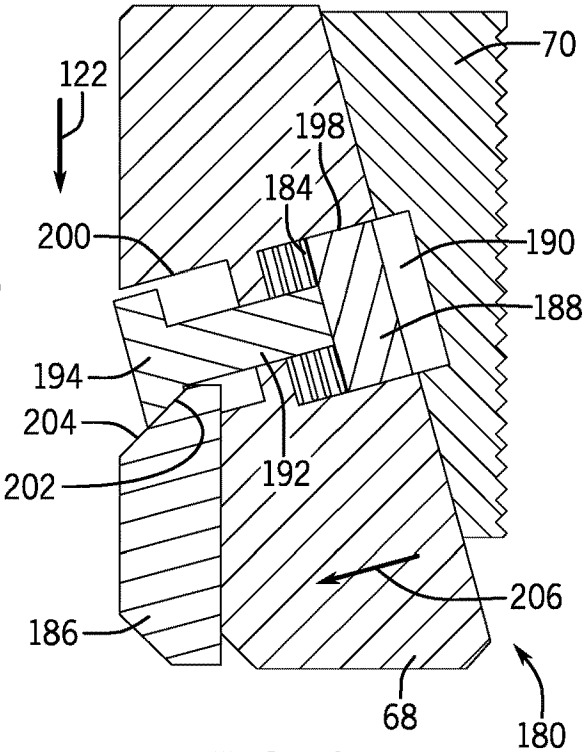
FIG. 9 is a cross-sectional view of a slip release system of the hanger system along line 8-8 of FIG. 2, in accordance with an embodiment of the present disclosure.

FIG. 9 is a cross-sectional view of the slip release system 180 of the hanger system 60 in a retracted positioned. In order to retract the first piston head 188 from the recess 190, the carrier 168 is lowered in direction 122 until the load release lug 186 contacts the second piston head 194. As the second piston head 194 contacts the release lug 186, an angled surface 202 on the second piston head 194 contacts a corresponding angled surface 204 on the release lug 186. The contact between these two angled surfaces 202, 204 drives the second piston head 194 in direction 206. As the dumbbell piston 182 moves in direction 206, the first piston head 188 compresses the spring 184, which enables the first piston head 188 to retract out of the recess 190 in the slip segment 70. Once the first piston head 188 retracts into the first counterbore 198, the slip segment 70 is able to move in direction 122, as illustrated in FIG. 10, to facilitate engagement with the tubing string 20.

Figure 11:
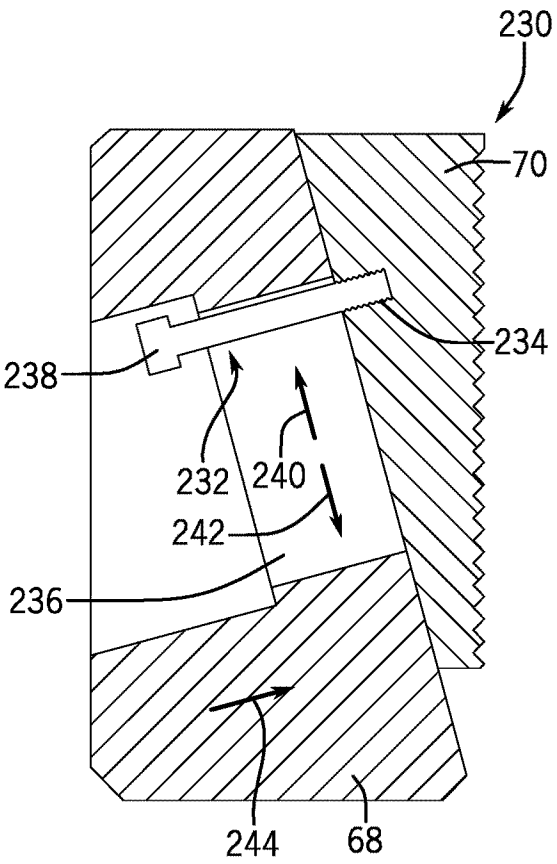
FIG. 11 is a cross-sectional view of a slip retainment system of the hanger system along line 11-11 of FIG. 2, in accordance with an embodiment of the present disclosure.

FIG. 11 is a cross-sectional view of a slip retainment system 230 of the hanger system 60 along line 11-11 of FIG. 2. In some embodiments, the hanger system 60 may include one or more slip retainment systems 230 that block separation of the slip segments 70 from the carrier 68. The slip retainment system 230 includes a connector 232 (e.g., threaded connector) that couples to the slip segment 70. For example, the connector 232 may thread into a recess 234 of the slip segment 70. The connector 232 extends through an aperture 236 in the carrier 68 to couple to the slip segment 70. To block the connector 232 from passing through the aperture 236, the connector 232 includes a head 238, which has a width greater than the width of the aperture 236. Accordingly, the connector 232 may slide in directions 240 and 242 within the aperture 236 as the slip segment 70 moves while blocking complete separation of the connector 232 from the carrier 68 in direction 244.

Figure 13:
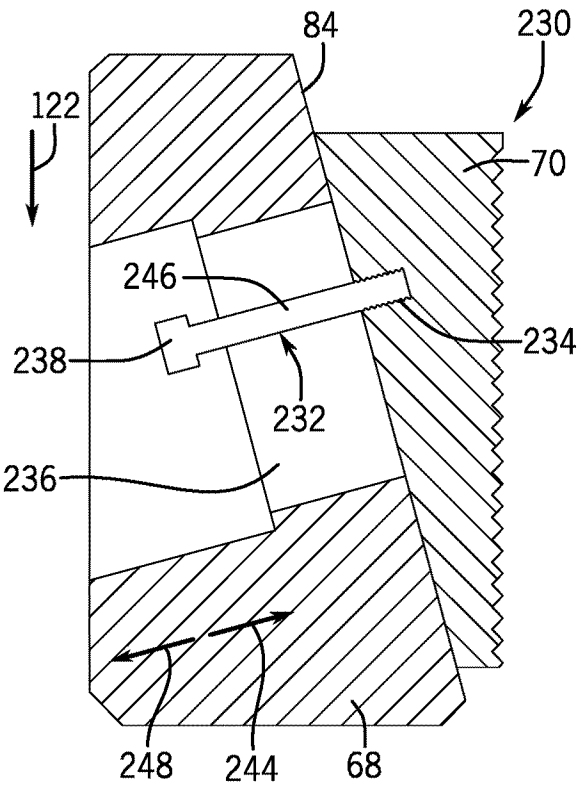
FIG. 13 is a cross-sectional view of a slip retainment system of the hanger system along line 11-11 of FIG. 2, in accordance with an embodiment of the present disclosure.
Figure 12:
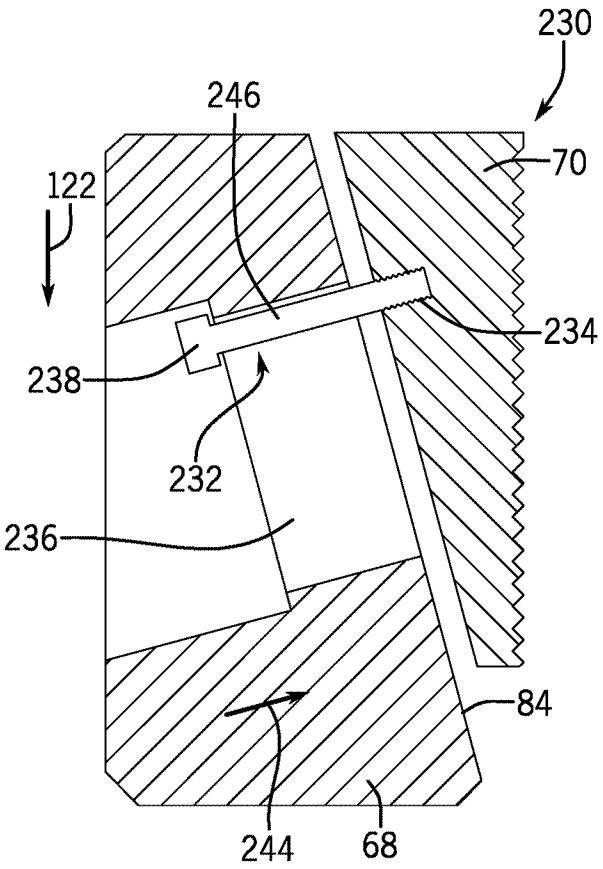
FIG. 12 is a cross-sectional view of a slip retainment system of the hanger system along line 11-11 of FIG. 2, in accordance with an embodiment of the present disclosure.

FIGS. 12 and 13 are cross-sectional views of the slip retainment system 230 of the hanger system 60 along line 11-11 of FIG. 2. As illustrated, the connector 232 includes a shaft 246 with a length sufficient to allow the slip segment 70 to pull away from the interior surface 84 of the carrier 68 in direction 244 and to retract in direction 248 to enable withdrawal of the hanger system 60 from the wellhead 12.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The invention claimed is:

1. A system, comprising:

a wellhead, the wellhead defining a bore;

a hanger system configured to be positioned within the wellhead, the hanger system comprises:

a piston angled relative to a longitudinal axis of the bore;

a collar configured to couple to the piston;

a first spring configured to bias the piston in a first direction, wherein the piston is configured to contact a slip segment to couple the slip segment to a casing string; and a second spring configured to bias the collar in a second direction, wherein the second direction is opposite the first direction.

2. The system of claim 1, comprising a carrier configured to receive the piston and the first spring.

3. The system of claim 1, wherein the collar couples to a shaft of the piston with a shear pin.

4. The system of claim 1, comprising a load lug configured to contact and energize the collar.

5. The system of claim 4, wherein the load lug defines a first angled surface configured to contact a second angled surface on the collar.

6. The system of claim 1, comprising the slip segment.

7. The system of claim 6, wherein the slip segment defines a groove, and wherein the piston is configured to rest within the groove.

8. The system of claim 6, wherein the slip segment comprises a plurality of teeth configured to contact an outer surface of the casing string.

9. A system, comprising:

a hanger system configured to be positioned within a wellhead, wherein the hanger system is configured to couple to and support a casing string within the wellhead, the hanger system comprises:

a piston;

a first spring configured to bias the piston in a first direction, wherein the piston is configured to contact a slip segment to couple the slip segment to a conduit;

a collar coupled to the piston; and a second spring configured to bias the collar in a second direction, wherein the second direction is opposite the first direction.

10. The system of claim 9, comprising a carrier configured to receive the piston, the first spring, the collar, and the second spring.

11. The system of claim 9, wherein the collar couples to a shaft of the piston with a shear pin.

12. The system of claim 9, comprising a load lug configured to contact and energize the collar.

13. The system of claim 12, wherein the load lug defines a first angled surface configured to contact a second angled surface on the collar.

14. The system of claim 9, comprising the slip segment.

15. The system of claim 14, wherein the slip segment defines a groove, and wherein the piston is configured to rest within the groove.

16. A system, comprising:

a wellhead;

a casing string;

a hanger system configured to couple to and suspend the casing string within the wellhead, the hanger system comprises:

a piston;

a first spring configured to bias the piston in a first direction, wherein the piston is configured to contact a slip segment to couple the slip segment to the casing string;

a collar coupled to the piston; and a second spring configured to bias the collar in a second direction, wherein the second direction is opposite the first direction.

17. The system of claim 16, comprising the slip segment.

18. The system of claim 17, wherein the slip segment defines a groove, and wherein the piston is configured to rest within the groove.

* * * * *